US008464581B2

(12) United States Patent
Rytlewski et al.

(10) Patent No.: US 8,464,581 B2
(45) Date of Patent: Jun. 18, 2013

(54) PASSIVE MONITORING SYSTEM FOR A LIQUID FLOW

(75) Inventors: Gary L. Rytlewski, League City, TX (US); Nitin Y. Vaidya, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 251 days.

(21) Appl. No.: 12/779,537

(22) Filed: May 13, 2010

(65) Prior Publication Data

US 2011/0277544 A1 Nov. 17, 2011

(51) Int. Cl.
*E21B 47/10* (2012.01)

(52) U.S. Cl.
USPC ..... 73/152.29

(58) Field of Classification Search
USPC ..... 73/152.03, 152.18, 152.19, 152.21, 73/152.29, 152.31, 152.55; 166/250.11, 376
See application file for complete search history.

(56) References Cited

U.S. PATENT DOCUMENTS

| | | | | |
|---|---|---|---|---|
| 6,324,904 | B1 * | 12/2001 | Ishikawa et al. | 73/152.03 |
| 6,349,766 | B1 * | 2/2002 | Bussear et al. | 166/113 |
| 6,443,228 | B1 * | 9/2002 | Aronstam et al. | 166/250.11 |
| 6,645,769 | B2 | 11/2003 | Tayebi et al. | |
| 6,915,848 | B2 | 7/2005 | Thomeer et al. | |
| 6,935,425 | B2 * | 8/2005 | Aronstam | 166/250.11 |
| 7,424,910 | B2 | 9/2008 | Xu et al. | |
| 7,503,398 | B2 * | 3/2009 | LoGiudice et al. | 166/386 |
| 7,594,434 | B2 * | 9/2009 | Dagenais et al. | 73/152.54 |
| 7,625,846 | B2 * | 12/2009 | Cooke, Jr. | 507/260 |
| 7,775,286 | B2 * | 8/2010 | Duphorne | 166/376 |
| 8,025,104 | B2 * | 9/2011 | Cooke, Jr. | 166/376 |
| 2004/0231845 | A1 * | 11/2004 | Cooke, Jr. | 166/279 |
| 2007/0225175 | A1 * | 9/2007 | Cooke, Jr. | 507/219 |
| 2008/0024448 | A1 | 1/2008 | Chang | |
| 2008/0115932 | A1 * | 5/2008 | Cooke, Jr. | 166/250.01 |
| 2008/0149345 | A1 * | 6/2008 | Marya et al. | 166/376 |
| 2008/0262735 | A1 | 10/2008 | Thigpen et al. | |
| 2008/0316049 | A1 * | 12/2008 | Verret et al. | 340/854.6 |
| 2009/0025940 | A1 | 1/2009 | Rytlewski | |
| 2009/0107684 | A1 * | 4/2009 | Cooke, Jr. | 166/376 |

FOREIGN PATENT DOCUMENTS

| | | | |
|---|---|---|---|
| WO | 2008079485 | A2 | 7/2008 |
| WO | 2008079485 | A3 | 11/2008 |

* cited by examiner

*Primary Examiner* — John Fitzgerald

(57) ABSTRACT

A passive liquid flow monitoring system includes a monitoring device made of a liquid-soluble material in which coded transponders are releasably retained. The monitoring device may be deployed proximate a region of interest in a hydrocarbon-producing well. Characteristics of a liquid flow in the region of interest may be determined based upon detection of transponders that are released from the monitoring device when the monitoring device is exposed to the liquid flow.

22 Claims, 2 Drawing Sheets

PASSIVE MONITORING SYSTEM FOR A LIQUID FLOW

TECHNICAL FIELD

The present invention relates generally to monitoring of a liquid flow and, more particularly, to monitoring water production in a hydrocarbon-producing well.

BACKGROUND

Hydrocarbon-producing wells often suffer from an inflow of water at some time during their production life. In many wells, water is not produced initially, but as the hydrocarbons are removed from the reservoir, sub-surface water tends to enter the wellbore and migrate into high permeability regions and fractures. After a period of time, if left uncontrolled, the water may dissolve clays and channel in the earth formation, leading to the production of even more water. Eventually, the additional hydrostatic head from the water may reduce wellhead pressure, resulting in premature termination of the ability to produce hydrocarbons from the well.

Because of the detrimental effects of water production, today's well systems often include intelligent completion components that are deployed downhole to monitor and control the inflow of water and, thus, to reduce the amount of water produced. These intelligent completion systems generally include electronic sensors that monitor water inflow and transmit data to the surface via wireline or fiber optic cable. Although the amount of water in the produced liquid may be readily discerned by surface measurements, the electronic sensors can provide valuable information that may be used to identify the downhole locations or zones in the well that are producing water. Based on this location information, control signals may be generated by the intelligent completion system and communicated downhole to adjust various downhole completion components, such as valves, chokes, etc., in a manner that reduces the amount of water in the total volume of liquids produced from the well.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

Intelligent completion systems in hydrocarbon-producing wells generally include downhole electronic and mechanical systems to monitor various well parameters (e.g., temperature, pressure, flow) and control the production of hydrocarbons based on one or more of the monitored parameters. Due to the quantity and complexity of the components, these downhole electrical and mechanical systems can be costly. Moreover, given the harsh downhole environment, the reliability of the electronic and mechanical components tends to diminish over time, thus reducing the ability to monitor and effectively control conditions, such as water inflow, at later stages in the life of the hydrocarbon-producing well. Unfortunately, because water inflow generally does not occur during the early portion of the well life, an intelligent completion system that uses downhole electronic sensors to detect water production may be at its highest level of reliability when it is at its lowest level in terms of the value of the information it can provide. And, at the later stages of well life when an intelligent completion system could provide the most benefit in terms of information and control of water production, the system may be at its lowest level of reliability and productivity.

Accordingly, embodiments of the invention provide for monitoring water production in a well that is less complex and costly, but offers more long-term reliability, than known intelligent completion systems which rely on electronic sensors and monitoring techniques. In exemplary embodiments of the invention, water production monitoring is performed in a passive manner that does not rely on active downhole electronics to detect water inflow and transmit to the surface data indicative of the sensed parameters.

Figure 1:
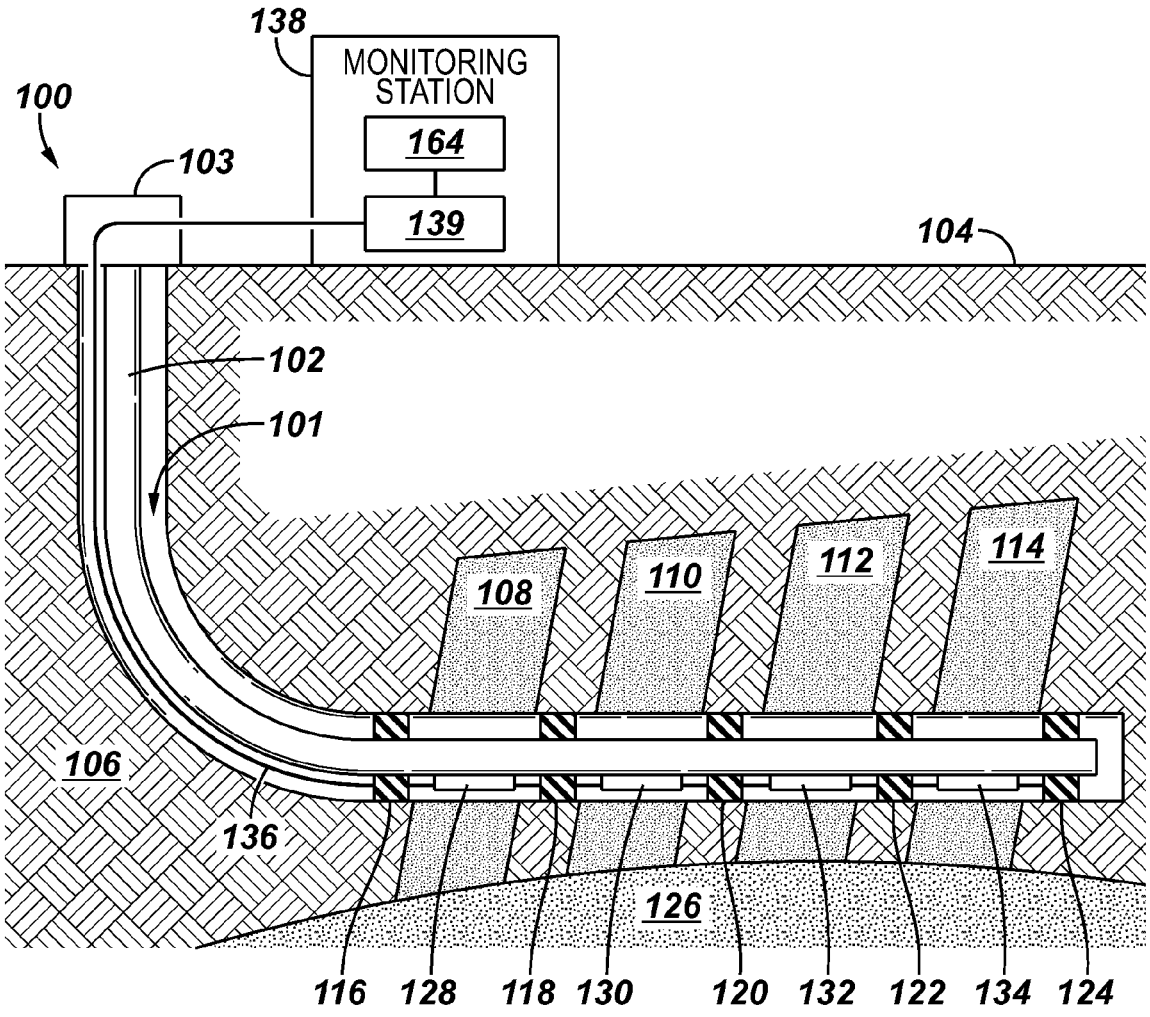
FIG. 1 is an illustrative well system in which an exemplary passive liquid flow monitoring system is deployed, in accordance with an embodiment of the invention.

An illustrative embodiment of an exemplary passive water inflow monitoring system is shown in FIG. 1. In FIG. 1, a well completion 100 includes a wellbore 101 that extends from a surface 104 into a surrounding earth formation 106 having a hydrocarbon-producing reservoir. In this embodiment, the wellbore 101 is shown as a horizontal well (although other types of wellbores, including vertical and deviated wellbores, also are contemplated) that is compartmentalized into a plurality of producing zones, such as zones 108, 110, 112, and 114, that are isolated from each other by packers 116, 118, 120, 122 and 124. As can be seen in FIG. 1, the wellbore 101 extends horizontally through the formation 106 above a water reservoir 126. The liquid flow from each zone is ported through a respective downhole completion component 128, 130, 132, and 134 (e.g., variable chokes, adjustable valves, etc.) before entering a production tubing 102. A control or data transmission line 136 (e.g., a wireline, fiber optic cable, etc.) also is deployed in the wellbore 101. The control line 136 is coupled to a surface monitoring station 138 for transmitting and receiving various control, status, and data signals to and from downhole completion components. For instance, in the embodiment shown, control signals for adjusting or closing each of variable valves 128, 130, 132, and 134 may be transmitted via the transmission line 136 to reduce the amount of water produced from a particular zone.

Figure 2:
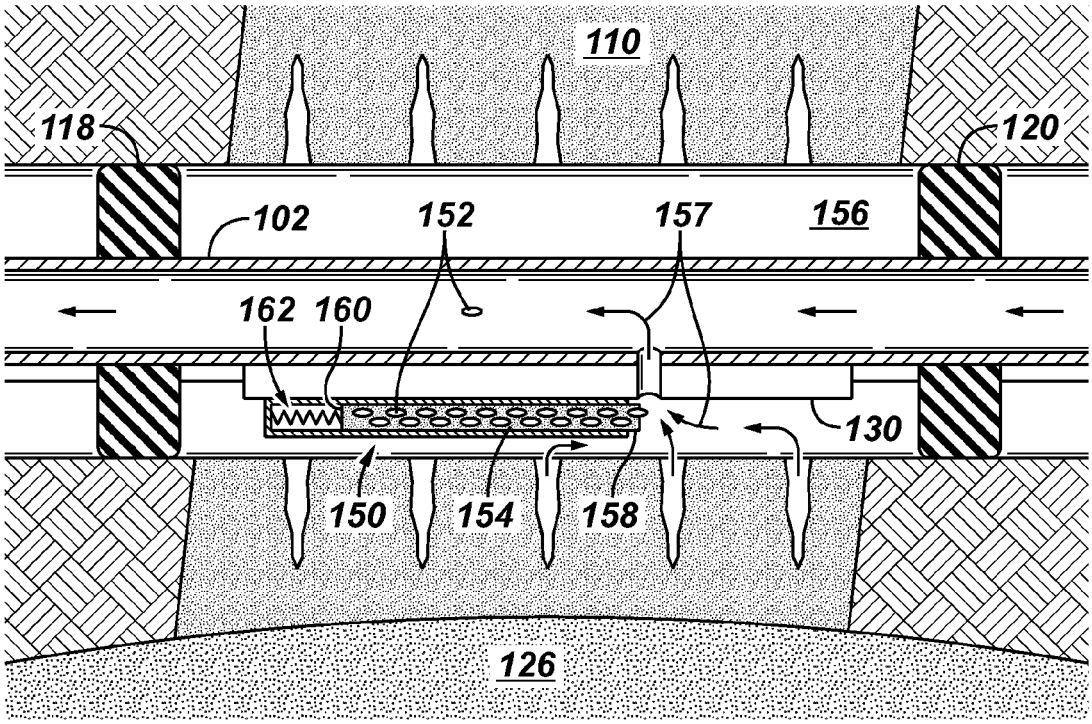
FIG. 2 is a close-up view of a portion of the liquid flow monitoring system deployed in the well system of FIG. 1, in accordance with an embodiment o the invention.

Turning now to FIG. 2, a close-up view of a portion of the well completion 100 of FIG. 1 is shown to provide an illustration of an exemplary embodiment of a portion a passive water production monitoring system 150 in the vicinity of the production zone 110. In FIG. 2, liquid production (both hydrocarbon and water) from the zone 110 is ported through the adjustable valve 130 located between packers 118 and 120. In this embodiment, the passive monitoring system 150 includes a plurality of transponders 152 (e.g., coded memory tags, radio frequency identification devices (RFIDs), etc.) that are embedded within a material that is at least partially soluble in water. In the embodiment shown, the soluble material and the embedded transponders 152 form a passive water monitoring device 154 that is configured as an elongate strip, although other shapes and configurations are contemplated depending on the environment and location in which the monitoring device 154 is deployed. Regardless of the application, the monitoring device 154 is configured and deployed in the monitored environment such that the embedded transponders 152 are released from the water-soluble material as the material dissolves in response to exposure to a water flow stream. In embodiments of the invention, the release of the transponders 152 is controlled so that subsequent detection of the transponders 152 at the surface 104 may provide an indication of characteristics of a water flow, such as the presence, location, and rate of water flow, in the well system 100. In embodiments in which multiple zones are monitored in the well system 100, the controlled release of the transponders 152 may also provide information on which zone is producing the most water. The information derived from the release of the transponders 152 may then be used to reduce the amount of water produced, such as by adjusting or closing downhole components (e.g., valve 130). For instance, the surface monitoring station 138 may include a control system 139 to generate control signals to communicate to the downhole components via the control line 136. In such embodiments, the control system 139 may include various processing devices or microcontrollers that are configured to generate appropriate control signals in response to or based upon the characteristics of the water flow that are derived from the detection of the released transponders.

With reference to FIG. 2, in one embodiment, the passive monitoring system 150 may include one or more monitoring devices 154 or strips that may be deployed in the wellbore 101 proximate the regions from which water may enter the wellbore 101. For instance, the monitoring device 154 may be attached to and deployed with the tubing 102 at the time the tubing 102 is installed in the wellbore 101. In the embodiment shown in FIG. 2, a monitoring strip 154 is deployed in an annular space 156 on the outside of the production tubing 102 between packers 118 and 120 such that a portion of the strip 154 extends into a flow stream 157 of the liquids entering the tubing 102 through the valve 130. Similar monitoring strips 154 may be deployed proximate the other producing zones (e.g., zones 108, 112, 114) of the reservoir. In each deployment location, the length of the monitoring strip 154 may extend along substantially the entire distance or along only a portion of the distance between adjacent packers.

Release of the transponders 152 from the monitoring strip 154 may be controlled by exposing only portions of the strip 154 to the flow 157 of water at any one time. For instance, in the exemplary embodiment of FIG. 2, only an end portion 158 of the strip 154 is exposed to the flow pathway of the valve 130. As the end portion 158 of the strip 154 dissolves and releases embedded transponders 152, a biasing force exerted on the opposing end 160 of the strip 154 maintains an undissolved portion in the flow stream 157 entering the pathway. In FIG. 2, the biasing force is provided by a biasing member 162, such as a spring or other resilient device. In other embodiments, the biasing member 162 may include a piston. In such embodiments, the monitoring strip 154 may be moved into the pathway of flow stream 157 by creating a lower pressure in the tubing 102 than in the annular space 156 in which the monitoring strip 154 is stored. Generally, such a pressure differential will be present due to the flow restriction introduced by the choke or valve 130. Regardless of the particular configuration, since passive monitoring is implemented by dissolving the water-soluble material to release the transponders 152, the length of the monitoring strip 154 will generally determine the useful life of the passive monitoring system 150.

Figure 3:
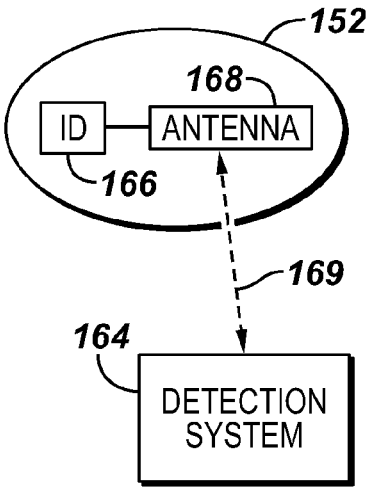
FIG. 3 is an exemplary transponder and detection system in accordance with an embodiment of the invention.

More particularly, as shown in FIG. 2, an inflow 157 of water entering the tubing 102 through the port 130 encounters and dissolves the exposed end 158 of the monitoring strip 154. As the strip 154 dissolves, the force applied by the biasing member 162 moves the strip 154 such that an exposed end of the strip 154 is maintained in the liquid flow stream 157 entering the tubing 102 through the valve 130. The embedded transponders 152 that are released into the liquid stream 157 when the strip dissolves travel through the production tubing 102 towards the surface 104 where the transponders 152 may be detected at the surface 104, such as by a detection system 164 located in the surface monitoring station 138. For instance, as shown in FIG. 3, each transponder 152 may include a stored or encoded identifier 166 and an antenna 168. An interrogation signal 169 from the surface detection system 164 may extract the identifier 166 such that it can be received and read at the surface 104.

The detected identifier 166 may then be used to determine characteristics of the water production in the wellbore 101, such as the location of the water flow, the flow rate, and/or the relative amount of water being produced at one or more locations in the wellbore 101. As an example, the water production monitoring system 150 may include a plurality of monitoring devices 154, each of which is deployed proximate a particular producing zone. In this example, all of the transponders 152 in a particular monitoring device 154 may be coded with an identifier 166 that is unique for that particular monitoring device 154. Thus, the locations or zones in the well that are producing water may be readily discerned based on the monitoring-device-specific identifiers 166 of the released transponders 152 that are detected by the detection system 164. In addition, the transponders 152 in each device 154 are arranged in a substantially uniform manner along the length of the device 154, with the density of the transponders 152 being substantially the same for all devices 154 deployed in the well system 100. Thus, the rate of liquid flow in a particular zone and/or the zone or zones that are producing the most water relative to other zones may be determined based on the frequency at which transponders 152 from the zones are released and detected by the detection system 164. In some embodiments, this information may be used to generate control signals for controlling the position of the valves 128, 130, 132, 134 in the various zones and, thus, to reduce the amount of water in the total volume of liquids produced from the well.

In other embodiments, the identifiers 166 for the transponders 152 may be further coded with information that indicates the position of the transponder 152 in the monitoring strip 154. For instance, the transponders 152 embedded in the strip 154 may be sequentially numbered, with the lowest number corresponding to the transponder 152 (or subset of transponders 152) located at the end 158 of the strip 154 that is closest to the inflow port of the valve 130 and the highest number corresponding to the transponder 152 (or subset of transponders 152) located at the end 160 of the strip 154 that is furthest from the inflow port. By coding the transponders 152 in a sequential or position-dependent manner, an indication of the remaining length (and, thus, the remaining life) of the monitoring strip 154 may be provided.

The material in which the transponders 152 are embedded may be any type of suitable liquid-soluble material (either wholly or partially soluble) that sufficiently dissolves or degrades in the liquid environment such that the controlled release of the embedded transponders 152 into the liquid flow stream results. In some embodiments, the controlled release of the transponders 152 may be adjusted and/or fine tuned by adjusting the solubility of the embedding material. For instance, the material may be soluble in water, but not soluble in hydrocarbons, such as oil or gas. In other embodiments, the material may have different degrees of solubility in different liquids. For instance, the material may be highly soluble in water and substantially less soluble in hydrocarbons. By introducing a limited degree of solubility in hydrocarbons, a corresponding limited release of transponders 152 may occur, thus providing an indication that the passive monitoring system 150 is functional. In such embodiments, the rate of dissolution between water and hydrocarbons is substantially different so that zones that are producing more water relative to other zones release the transponders 152 more frequently. Yet further, the solubility of the embedding material may be adjusted based on other parameters. For example, each of the monitoring strips 154 may have different rates of dissolution based on the temperature of the environment in which they are deployed.

Suitable liquid-soluble materials in which the transponders 152 may be embedded include soluble polymers (e.g., polylactic acid (PLA) and soluble polyetheretherketone (PEEK)) and soluble metals (including semi-metals) (e.g., calcium, gallium, indium, tin, antimony, manganese, tungsten, molybdenum, chromium, germanium, silicon, selenium, tellurium, polonium, arsenic, phosphorus, boron, carbon, carboxylated carbon, combinations of the foregoing and the like), including, for instance, examples of liquid-soluble materials identified in U.S. Patent Publication 2009/0025940. The solubility of such materials may be chemically adjusted as desired to achieve a controlled release of the transponders 152 in the presence of a liquid flow stream having particular characteristics. For instance, PEEK may be solubilized by functionalization of the polymer chains to include sulfonic acid groups. The solubility of PEEK may be increased by increasing the degree of sulfonation. As one example, sulfonation of PEEK for 168 h makes PEEK soluble in water above 80° C. Similarly, the solubility of PLA may be altered by blending the PLA with other soluble polymers, such as polyvinyl alcohol (PVOH). Other suitable techniques also may be used to adjust the solubility of the material of the monitoring device 154 so that release of the transponders 152 is controlled in a manner that provides information about the liquid flow stream in the monitored region.

Figure 4:
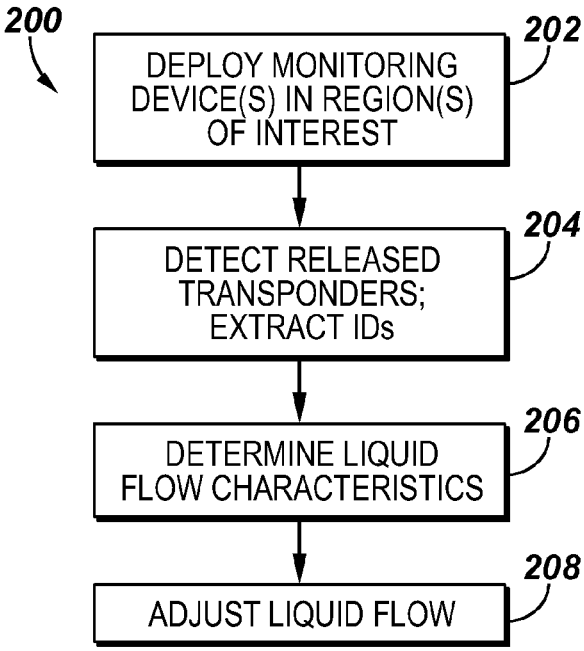
FIG. 4 is a flow chart of an exemplary liquid flow monitoring technique, in accordance with an embodiment of the invention.

FIG. 4 provides a flow chart of an exemplary technique 200 for monitoring a liquid flow stream. One or more liquid monitoring devices 154 having embedded transponders 152 are deployed at one or more corresponding locations in a region of interest (block 202). Each of the transponders 152 is coded with an identifier that is unique for the monitoring device 154 in which the transponder 152 is embedded. The identifier also may be unique for each transponder 152 or subset of transponders 152. The monitoring devices 154 release their respective transponders 152 in a controlled manner in response to the presence of a liquid flow stream at the monitored location. The released transponders 152 are detected by the detection system 164 that extracts the identifiers 166 (block 204). Characteristics of the liquid flow, such as the location of the liquid flow stream, the rate of flow, and/or the locations that have the highest rate of liquid flow, may be determined based on the extracted identifiers 166 (block 204). In some embodiments, the remaining life of the monitoring device 154 may also be determined based on the extracted identifiers. The liquid flow in one or more of the monitored regions may then be adjusted based on or in response to the determined characteristics (block 206).

In some embodiments, the techniques or portions of the techniques described herein (including the technique 200 in FIG. 4) may be implemented by employing a processing device (e.g., one or more microprocessors, microcontrollers, etc.) to execute code or instructions of software stored in a tangible storage medium (e.g., a memory device having durable and/or non-durable storage elements). It should be further understood that the techniques may include additional steps, fewer steps, and/or different steps than those described herein.

Although the foregoing embodiments have been described with respect to water production in a well, it should be understood that the monitoring system and techniques may also be used to monitor water injection in a well. Moreover, while the foregoing embodiments have been described in the context of hydrocarbon production, it should be understood that the system and techniques also may be used in any other applications in which monitoring of liquid flow is desired.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A system to monitor a liquid flow in a hydrocarbon well, comprising:

a first monitoring device to deploy proximate a region of interest in a wellbore that extends from a surface, the monitoring device comprising a plurality of first transponders releasably retained in a material that is soluble in a first liquid;

a detection system located at the surface to detect first transponders released from the material in response to exposure of the first monitoring device to a flow of the first liquid in the region of interest; and a biasing device to maintain a portion of the first monitoring device in the flow of the first liquid when the first monitoring device is exposed to the flow of the first liquid and the material dissolves.

2. The system as recited in claim 1, further comprising a control system in communication with an adjustable completion component to selectively restrict the flow of the liquid through the liquid pathway based on detection of released first transponders.

3. The system as recited in claim 1, wherein the first liquid comprises water, and wherein the material comprises a water-soluble polymer or a water-soluble metal.

4. The system as recited in claim 1, further comprising a second monitoring device to deploy proximate a second region of interest in the wellbore, the second monitoring device comprising a plurality of second transponders releasably retained in a material that is soluble in the first liquid.

5. The system as recited in claim 4, further comprising a control system in communication with a downhole component to selectively restrict the flow of the first liquid from at least one of the first region of interest and the second region of interest based on a detected rate of release of the first transponders relative to the second transponders.

6. The system as recited in claim 1, wherein the first transponders are arranged between first and second undissolved ends of the first monitoring device, and wherein the biasing device to apply a force against the first undissolved end of the first monitoring device to maintain the second undissolved end in the flow of the first liquid.

7. The system as recited in claim 6, wherein the first transponders are substantially uniformly arranged between the first and second undissolved ends of the first monitoring device.

8. The system as recited in claim 7, wherein the first monitoring device is deployed such that the second undissolved end extends into a liquid pathway of an adjustable completion component located in the wellbore.

9. A method of monitoring a liquid flow in a wellbore, comprising:

deploying a passive monitoring device in a region of interest in the wellbore, the passive monitoring device comprising a plurality of transponders releasably retained in a liquid-soluble material;

detecting transponders released from the passive monitoring device into a liquid flow in the region of interest;

determining characteristics of the liquid flow based on detection of the released transponders; and maintaining an undissolved portion of the passive monitoring device in a liquid flow pathway in the region of interest as transponders are released from the liquid-soluble material.

10. The method as recited in claim 9, further comprising restricting liquid flow through the liquid flow pathway based on a detected rate of release of transponders.

11. The method as recited in claim 10, wherein the liquid flow pathway is an adjustable inflow port of a downhole component, and wherein restricting the liquid flow comprises communicating a control signal to adjust the adjustable inflow port.

12. The method as recited in claim 10, wherein the liquid is water.

13. A method of monitoring a flow of water in a region of interest, comprising:

controlling release of transponders retained by a water flow monitoring device in response to detection of a flow of water in the region of interest, the water flow monitoring device made of a water-soluble material, wherein controlling release of the transponders comprises exposing only a portion of the water flow monitoring device to the flow of water;

detecting the released transponders; and determining characteristics of the flow of water based on the detection of the released transponders.

14. The method as recited in claim 13, wherein controlling release of the transponders comprises adjusting a solubility of the water-soluble material.

15. The method as recited in claim 13, wherein the characteristics comprise at least one of rate of flow and location of flow within the region of interest.

16. The method as recited in claim 13, wherein the water flow monitoring device extends between a first undissolved end and a second undissolved end, and wherein controlling release of the transponders comprises exposing only the first undissolved end of the water flow monitoring device to the flow of water.

17. The method as recited in claim 16, wherein controlling release of the transponders comprises applying a biasing force on the second undissolved end of the water flow monitoring device to maintain the first undissolved end in the flow of water as the water soluble material dissolves.

18. A passive liquid monitoring device comprising:

a monitoring strip formed of a material having a first solubility in a first liquid;

a plurality of transponders releasably retained in the material and arranged between first and second undissolved ends of the monitoring strip, the plurality of transponders including an identifier that corresponds to the monitoring strip in which the transponders are retained; and a biasing device to exert a force on the first undissolved end of the monitoring strip to maintain the second undissolved end in a liquid flow pathway as the material dissolves and the transponders are released.

19. The device as recited in claim 18, wherein the identifier further corresponds to a position of the transponder between the first and second undissolved ends of the monitoring strip.

20. The device as recited in claim 18, wherein the first liquid is water, and the material comprises a water-soluble polymer or a water-soluble metal.

21. The device as recited in claim 18, wherein the transponders are substantially uniformly arranged between the first and second undissolved ends of the monitoring strip.

22. The device as recited in claim 18, wherein the monitoring strip is deployed in a hydrocarbon-producing well.

* * * * *